US005094286A

United States Patent [19]

Hansen

[11] Patent Number: 5,094,286

[45] Date of Patent: Mar. 10, 1992

[54] LOUVER

[76] Inventor: Don Hansen, 1703 E. Heritage Cir., Anaheim, Calif. 92804

[21] Appl. No.: 741,953

[22] Filed: Aug. 8, 1991

[51] Int. Cl.[5] ..... E06B 9/30

[52] U.S. Cl. ..... 160/168.1; 160/236

[58] Field of Search ..... 160/236, 900, 178.1, 160/168.1; 29/245; 139/384 A

[56] References Cited

U.S. PATENT DOCUMENTS 4,049,038 9/1977 Hyman et al. .

4,195,680 4/1980 Hyman et al. .

4,628,980 12/1986 Le Houiller .

4,884,616 12/1989 Setele ..... 160/236

*Primary Examiner*—Blair M. Johnson

*Attorney, Agent, or Firm*—James G. O'Neill

[57] ABSTRACT

The louvers of vertical louver system are provided with strengthened and color changing resistant clear transparent holding means that is secured to each louver as a clear transparent unitary assembly on a back, that may be clear and transparent or opaque, over the entire mating surfaces of the holding means and the back.

10 Claims, 1 Drawing Sheet

LOUVER

BACKGROUND OF THE INVENTION

1. Field of the Invention

This invention relates generally to vertical louvers and more particularly to an improved vertical louver having strengthened, transparent holding flanges on the longitudinal edges thereof.

2. Description of Related Art

Vertical louvers having holding flanges to retain decorative panels therein are known. Examples of such known louvers having opaque holding flanges are shown by U.S. Pat. Nos. 4,049,038 and 4,195,680. However, these known louvers were found to be unsatisfactory, because the opaque holding flanges formed broad vertical lines which destroyed the overall decorative appearance of panels formed by a plurality of such vertical louvers. After numerous attempts to solve the problems which occur because of these broad, appearance-destroying opaque holding flanges, the need for a simple, low-cost, easy to manufacture vertical louver, having clear or transparent holding flanges which have a long life, are simple and comparatively low in cost to manufacture, and do not easily break or detach from the panel to which they are attached, still exists.

One prior art louver having clear holding flanges which overcame some of the known problems, such as elimination of the vertical lines in the decorative appearance of a plurality of vertically hanging panels, is shown by U.S. Pat. No. 4,628,980. However, the clear, generally C-shaped holding flanges shown in this patent, although they overcame many of the existing problems, caused new problems of their own. These problems arise because of the manner in which the clear C-shaped flanges are formed and how they are attached to the opaque portion of the louver along the longitudinal edges thereof. Although no explanation of how the clear flanges are attached to the edges of the louvers can be found in this patent, the flanges are attached in such a manner, that a dividing line, forming a weakened area is produced where the clear flanges are attached to the edges of 10 the louver. Therefore, the clear flanges may be easily knocked off or become detached from the louver, if abused, struck or the louver is not carefully installed and/or handled. Furthermore, at least a portion of the clear flange is toward the rear of the louver so that prolonged exposure to sunlight or other elements in the atmosphere of a room where the louvers are hung, causes discoloration of the holding flanges as well as further deterioration of the weakened area where the flanges are attached along the edges of the louver. Such discolored flanges are unsightly, and the flanges loose their transparency over time, thereby providing demarcation lines of the type they were designed to eliminate. Furthermore, the clear flanges may become loose or detached from the louvers, thus resulting in the loosening or movement of the material held in the louver, and greatly detracting from the decorative appearance of the hanging louvers.

SUMMARY OF THE INVENTION

Accordingly, it is a general object of the present invention to provide an improved transparent vertical louver holding flange. It is a particular object of the present invention to provide a strengthened transparent vertical louver holding flange which is easy to manufacture. It is a still more particular object of the present invention to provide a vertical hanging louver having transparent holding flanges, coextruded with the louver to eliminate any weakened areas, for insertion and holding of decorative panels that may be hung with similar louvers.

In accordance with one aspect of the present invention, there is provided an elongated vertical louver, useful with identical louvers, secured in the vertical position and supported from a louver track system, and which is adapted to hold decorative materials to form a decorative panel, by means of transparent holding flanges formed to the louver by coextrusion. Additionally, the present invention provides strengthened 10 transparent holding flanges that support decorative materials therein without forming longitudinal dividing edges along the supported decorative material.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
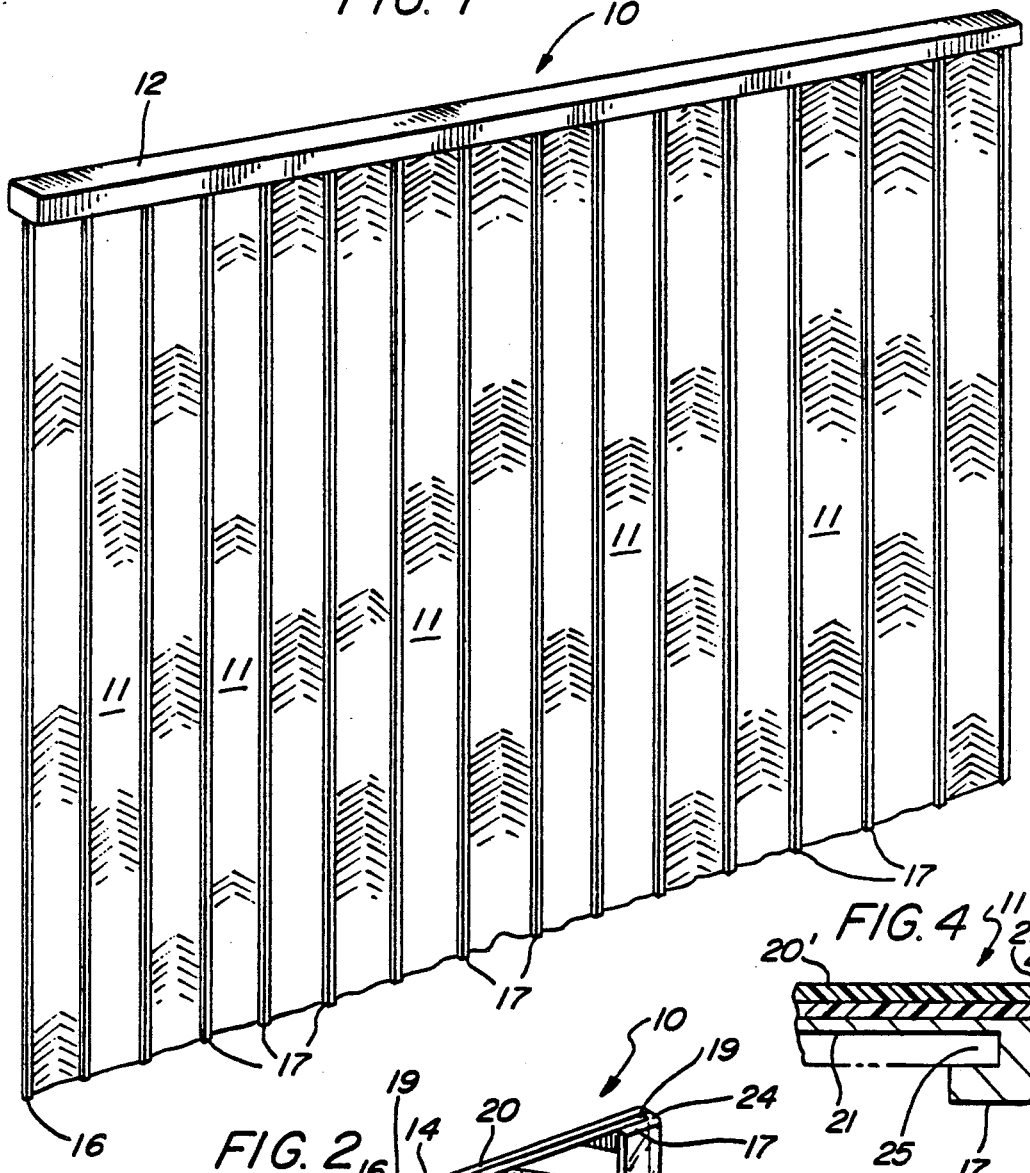
FIG. 1 is an isometric view of a vertical louver system supporting a plurality of vertical louver panels of the present invention in overlapping relationship.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved vertical louver assembly, identified generally at 10 in the drawings.

It is to be understood that the present invention is an improvement to the transparent or clear-edged louver and the system in which it is to be used, as more fully disclosed in U.S. Pat. No. 4,628,980, the disclosure of which patent is hereby incorporated herein, in its entirety, by this reference thereto.

Figure 2:
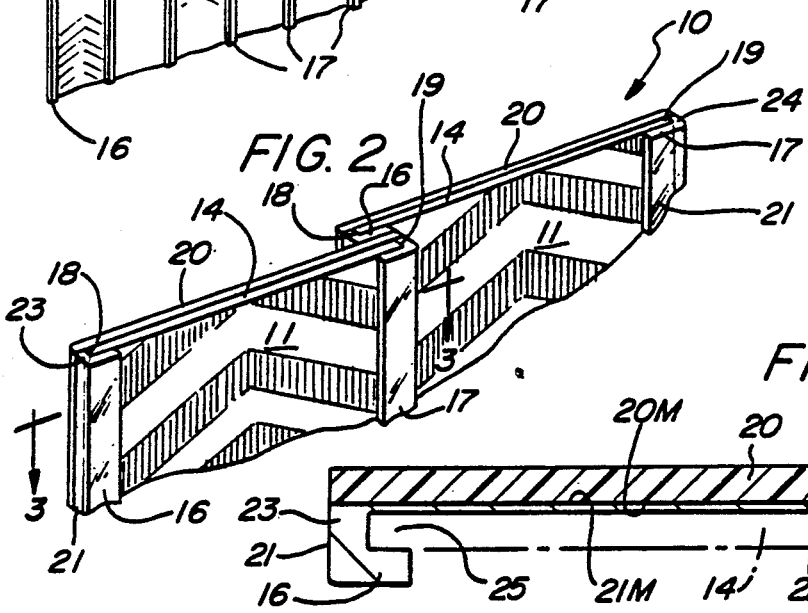
FIG. 2 is an enlarged sectional view of a pair of louvers of the present invention showing the improved transparent holding flanges.

FIGS. 1 and 2 of the drawings illustrate the assembly 10 as a decorative panel comprised of a plurality of separate, overlapping vertical louvers 11, held in a track system 12, in a known manner. Each vertical louver 11 further includes a decorative panel 14, inserted and held therein, in a known manner, to form the louver assembly or decorative panel 10.

Figure 3:
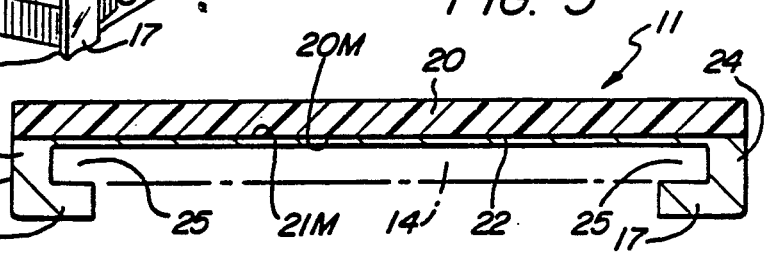
FIG. 3 is a cross-sectional end view of a louver taken along line 3—3 of FIG. 2.

FIGS. 2 and 3 most clearly show clear or transparent holding flanges or edges 16, 17, which comprise a portion of each of the improved louvers 11. The clear edges 16 and 17 include interior surfaces which hold the decorative panel 14 in the louver, with the extreme side edges 18, 19 of the decorative panel showing through these transparent edges. In addition, each louver 11 is shown as being formed from two distinctive portions or sections 20, 21, described more fully hereinafter.

Figure 4:
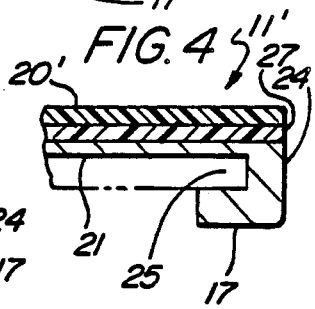
FIG. 4 is an enlarged partial cross-sectional end view of a further embodiment of the invention.

The sections 20, 21 may be formed separately and held or fixed together in any known or desired manner. However, in the preferred embodiment of the invention, the sections 20 and 21 are coextruded, and bonded together, in a known manner, entirely along their mating surfaces 20M, 22M during the coextrusion process. As shown, the rear or back section 20 is preferably formed as a rectangle, from an opaque material, such as a rigid PVC compound, either alone or mixed with acrylics or various polymers. If desired, however, the louver could be made as is shown in FIG. 4. In FIG. 4, a louver 11' is shown having a back section 20' made from a clear transparent material, preferably one that does not discolor over time if exposed to sunlight, such as an acrylic. A layer of opaque material 27 is then placed between the two clear, transparent. sections 20', 21 when they are secured together, in a manner known to those skilled in the art.

However, in the preferred embodiment of the invention, the section 20 is made from an opaque material that is thick enough to provide sufficient strength and complete light blockout therethrough, as well as energy conservation. The energy conservation occurs, in a known manner, by the reflection back of solar radiation in summer, and heat savings in winter, because the thick back 20, closes tightly with adjacent louvers.

The front or holding section 21 of each louver is preferably made in one piece from a clear or transparent plastic, or other material, that is compatible with and easily coextruded or otherwise formed with, or fixed to, the back 20, along the mating surfaces 20M, 22M. The front section 21 could, of course be made from separate elements or parts, fused or otherwise held together to form a whole. However, in the preferred embodiment as shown in FIG. 3, the front section is formed as a unitary or integral holding element that includes the clear holding edges 16 and 17, a clear or transparent rear wall 22 and clear, transparent side legs or portions 23, 24. As shown, the rear wall 22 is formed thinner than, but identical in width with the rectangular, back 20, to which it is fixed. The transparent side edges or legs 23, 24, separate the interior surfaces of the interior surfaces of the holding edges 16, 17 and the interior surface of the rear wall 22. The legs 23, 24 are of sufficient length to form a space or opening 25, of the desired size, in which the panel material 14 is inserted and firmly held in place by the inner surfaces of the integral or unitary holding assembly 21.

It, therefore, can be seen that the louvers of the present invention include integral or unitary, transparent holding assemblies which are securely fixed to the opaque back in such a manner that neither the holding edges nor the side edges or legs thereof will be as susceptible to breaking or other forms of deterioration, as in known louvers. Furthermore, the opaque material 27 between the back 20' and the unitary front section, or the thick, opaque back 20 will substantially block any light or harmful solar or other radiation that might cause deterioration or discoloration of the plastics or other materials used, as is currently the case with available transparent holding flange-type louvers.

Although it would appear that a minute portion of the opaque back 20, equivalent to the thickness of the side legs or edges 23, 24 (each approximately 0.022" thick), may show through these legs, in reality this is not the case.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What I claim is:

1. A louver system comprising a louver track system and plurality of louvers, each louver being held vertically by said track system and comprising an elongate, substantially rectangular back having decorative panel holding means secured thereto, and wherein:

said rectangular back is opaque;

said holding means comprises a unitary assembly having a rear wall, a pair of legs and a pair of edge flanges integrally formed entirely from a clear transparent material, with said transparent holding assembly and said opaque back formed together by coextrusion so that said opaque back is fixed to an outside surface of said rear wall of said holding means; and an opening formed in said unitary, transparent holding assembly between an interior surface of said rear wall, an interior surface on each of said pair of legs and an interior surface on each of said pair of edge flanges to hold said decorative panel entirely within said opening, between said interior surfaces.

2. The louver system of claim 1 wherein said interior faces of said pair of legs are spaced apart a distance equal to the width of said decorative panel.

3. The louver system of claim 2 wherein said interior surface of said rear wall is spaced apart from said interior surfaces of said pair of edge flanges a distance equal to the thickness of said decorative panel.

4. The louver system of claim 3 wherein said opaque back and said rear wall of said unitary, transparent holding assembly are fixed together entirely over mating surfaces thereof.

5. A louver system comprising a louver track system and plurality of louvers, each louver being held vertically by said track system and comprising an elongate, substantially rectangular back having decorative panel holding means secured thereto, and wherein:

said back is clear and transparent;

said holding means comprises a unitary assembly having a rear wall, a pair of legs and a pair of edge flanges integrally formed entirely from a clear transparent material, with said transparent holding assembly secured to said clear and transparent back by an outside surface of said rear wall;

a sheet of opaque material held between said clear and transparent back and said unitary, transparent holding means; and an opening formed in said unitary, transparent holding assembly between an interior surface of said rear wall, an interior surface on each of said pair of legs and an interior surface on each of said pair of edge flanges to hold said decorative panel entirely within said opening, between said interior surfaces.

6. The louver system of claim 5 wherein said interior faces of said pair of legs are spaced apart a distance equal to the width of said decorative panel.

7. The louver system of claim 6 wherein said interior surface of said rear wall is spaced apart from said interior surfaces of said pair of edge flanges a distance equal to the thickness of said decorative panel.

8. The louver system of claim 7 wherein said clear transparent back and said rear wall of said unitary, transparent holding assembly are fixed together entirely over mating surfaces thereof.

9. A louver system comprising a louver track system and plurality of louvers, each louver being held vertically by said track system and comprising an elongate, substantially rectangular back having decorative panel holding means secured thereto, and wherein:

said holding means comprises a unitary assembly having a rear wall, a pair of legs and a pair of edge flanges integrally formed entirely from a clear transparent material, with said transparent holding assembly fixed to said rectangular back by an outside surface of said rear wall;

an opening formed in said unitary, transparent holding means between an interior surface of said rear wall, an interior surface on each of said pair of legs and an interior surface on each of said pair of edge flanges to hold said decorative panel entirely within said opening between said interior surfaces; and said unitary, transparent holding assembly being formed as a channel coextruded with said back, and said channel holds said decorative panel securely therein.

10. The louver system of claim 9 wherein said back is opaque and said opaque back and said rear wall of said unitary, transparent holding assembly are fixed together entirely over mating surfaces thereof.

* * * * *